US007498557B2

(12) United States Patent
Pinkas et al.

(10) Patent No.: US 7,498,557 B2
(45) Date of Patent: Mar. 3, 2009

(54) CASCADED IMAGE INTENSIFIER

(75) Inventors: Iddo Pinkas, Rehovot (IL); Tal Kuzniz, Ariel (IL); Avishay Guetta, Rehovot (IL); Helmut Banzhoff, Pfullingen (DE); Ron Naftali, Shoham (IL)

(73) Assignee: Applied Materials Israel Ltd., Rehovot (IL)

( * ) Notice: Subject to any disclaimer, the term of this patent is extended or adjusted under 35 U.S.C. 154(b) by 348 days.

(21) Appl. No.: 11/516,667

(22) Filed: Sep. 7, 2006

(65) Prior Publication Data

US 2008/0272280 A1 Nov. 6, 2008

Related U.S. Application Data

(60) Provisional application No. 60/715,927, filed on Sep. 8, 2005, provisional application No. 60/715,900, filed on Sep. 8, 2005, provisional application No. 60/715,901, filed on Sep. 8, 2005.

(51) Int. Cl.
*H01J 40/14* (2006.01)
*H01J 43/00* (2006.01)

(52) U.S. Cl. ..... 250/214 VT; 313/103 CM; 313/105 CM; 313/525

(58) Field of Classification Search ..... 250/207, 250/214 VT; 313/525, 103 R, 103 CM, 104, 313/105 R, 105 CM
See application file for complete search history.

(56) References Cited

U.S. PATENT DOCUMENTS 3,215,484 A 11/1965 Burtt
3,491,233 A 1/1970 Manley
3,657,596 A 4/1972 Goetze et al.
3,711,720 A 1/1973 Kryder
3,875,440 A * 4/1975 McGee ..... 313/530
3,974,331 A 8/1976 Pepin
4,025,955 A 5/1977 Grallien et al.
4,100,445 A 7/1978 Suffredini et al.
4,155,024 A 5/1979 Sonoda
4,201,797 A 5/1980 Houtkamp (Continued)

FOREIGN PATENT DOCUMENTS

EP 0 305 644 A2 3/1989

(Continued)

OTHER PUBLICATIONS

Phosphor, http://en.wikipedia.org/wiki/Phosphor; pp. 1-7.

(Continued)

*Primary Examiner*—John R Lee
(74) *Attorney, Agent, or Firm*—Browdy and Neimark, P.L.L.C.

(57) ABSTRACT

A cascaded image intensifier device is presented. In one embodiment the device comprises: at least two sections in cascade, each of a first section and a last section out of the at least two sections including a photocathode unit adapted to convert photons to electrons and a screen unit adapted to convert electrons to photons; wherein the first section includes a reducing element adapted to: (i) reduce ion-caused degradation of a photocathode unit of the first section, and (ii) reduce a number of photons exiting from the first section from a first value to a second value; and wherein the last section outputs a number of photons that equals or exceeds the first value. Also disclosed are methods and systems using the disclosed cascaded image intensifier device.

25 Claims, 3 Drawing Sheets

U.S. PATENT DOCUMENTS

| | | | |
|---|---|---|---|
| 4,672,193 | A | 6/1987 | Duchenois et al. |
| 4,755,874 | A | 7/1988 | Esrig et al. |
| 5,315,103 | A | 5/1994 | Raverdy et al. |
| 5,319,189 | A | 6/1994 | Beauvais et al. |
| 5,349,177 | A | 9/1994 | Thomas et al. |
| 5,510,673 | A | 4/1996 | Wodecki et al. |
| 5,514,928 | A | 5/1996 | Niewold |
| 5,633,493 | A | 5/1997 | Suzuki et al. |
| 5,981,935 | A | 11/1999 | Raverdy |
| 6,040,000 | A | 3/2000 | Floryan et al. |
| 6,396,049 | B1 | 5/2002 | Estrera et al. |
| 6,661,508 | B2 | 12/2003 | Eytan et al. |
| 2005/0219518 | A1 | 10/2005 | Korngut et al. |

FOREIGN PATENT DOCUMENTS

| | | |
|---|---|---|
| GB | 1 313 919 | 4/1973 |
| GB | 1 436 564 | 5/1976 |

OTHER PUBLICATIONS

Scintillator, http://en.wikipedia.org/wiki/Scintillator, pp. 1-2.
http://lambert-instruments.com/technologies/1_english/4_technologies/3 _image; pp. 1-2.
Dussault, D. et al., "Noise performane comparision of ICCD with CCD and EMCCD cameras"; Germany.
http://www.proxitronic.de/prod/by/eein.htm; Introduction to Image Intensifier Tubes, pp. 1-6.
http://en.wikipedia.org/wiki/image_intensifier; Image Intensifier.

* cited by examiner

CASCADED IMAGE INTENSIFIER

CROSS REFERENCE TO RELATED APPLICATIONS

This application claims the benefit of U.S. Provisional Patent Application 60/715,927, U.S. Provisional Patent Application 60/715,900, and U.S. Provisional Application 60/715,901. Said applications were all filed on Sep. 8, 2005 and are hereby incorporated by reference herein.

FIELD OF THE INVENTION

This invention relates to image intensifier tubes.

BACKGROUND OF THE INVENTION

Image intensifier tubes (also known as IIT or image intensifiers) are widely used for sensing and amplifying, or intensifying, light images of low intensity. In these devices, light (usually of visible or near infra-red spectra) from an associated optical system is directed onto a photocathode which emits a distribution of photoelectrons in response to the input radiation.

Image intensifier tubes typically include a vacuum tube with a photocathode unit at one end and a screen unit at the other end. The photocathode unit converts incoming photons to electrons which are accelerated by an electric field (potential difference) in the tube until they hit the screen unit converting them back to photons.

Image intensifiers are used in various imaging and inspection systems, including those used in the semiconductor industry for manufacturing integrated circuits. In such systems, an image intensifier is appropriately located in front of an image sensor (e.g. CCD or CMOS camera). Such systems are disclosed for example in U.S. Pat. No. 6,661,508; EP 305644 and US 2005/0219518 all assigned to the assignee of the present application, and U.S. Pat. No. 4,755,874.

SUMMARY OF THE INVENTION

According to the present invention there is provided a cascaded image intensifier, comprising: at least two sections in cascade, each of a first section and a last section out of the at least two sections including a photocathode unit adapted to convert photons to electrons and a screen unit adapted to convert electrons to photons; wherein the first section includes a reducing element adapted to: (i) reduce ion-caused degradation of a photocathode unit of the first section, and (ii) reduce a number of photons exiting from the first section from a first value to a second value; and wherein the last section outputs a number of photons that equals or exceeds the first value.

According to the present invention there is also provided a cascaded image intensifier, comprising: at least two sections in cascade, each of a first section and a last section out of the at least two sections including a photocathode unit adapted to convert photons to electrons and a screen unit adapted to convert electrons to photons; wherein a screen unit in the first section includes a bulk scintillator; and wherein the last section outputs a number of photons that equals or exceeds a number of photons which would have been outputted by the first section, had the first section instead included a phosphor screen unit.

According to the present invention there is further provided a cascaded image intensifier, comprising: at least two sections in cascade, each of a first section and a last section out of the at least two section including a photocathode unit adapted to convert photons to electrons and a screen unit adapted to convert electrons to photons; and at least one voltage supply unit adapted to provide a potential difference between a photocathode unit and a screen unit in the first section that substantially ranges between 6 to 10 KV, and adapted to provide a potential difference between a photocathode unit and a screen unit in a section subsequent to the first section that substantially ranges between 20 to 30 KV; wherein the last section outputs a number of photons that equals or exceeds a number of photons which would have been outputted by the first section, had the at least one voltage supply unit been adapted to instead provide a potential difference between the photocathode unit and the screen unit in the first section that substantially ranges between 20 to 30 KV.

According to the present invention there is still further provided, a cascaded image intensifier, comprising: at least two sections in cascade, each of a first section and a last section out of the at least two sections including a photocathode unit adapted to convert photons to electrons and a screen unit adapted to convert electrons to photons, the photocathode unit in the first section made of material differing from Gallium-Arsenide; and an ion barrier film in the first section; wherein the last section outputs a number of photons that equals or exceeds a number of photons which would have exited from the first section, had the first section excluded the ion barrier film.

According to the present invention there is provided a method of increasing a lifetime of a cascaded image intensifier, comprising: providing an image intensifier comprising at least two sections in cascade, wherein each of a first and last section out of the at least two sections includes a photocathode unit adapted to convert photons to electrons and a screen unit adapted to convert electrons to photons, and wherein the first section comprises a reducing element adapted to reduce ion-caused degradation of a photocathode unit; receiving light directed toward the image intensifier; limiting a number of photons emitted by the first section compared to a number of photons which would have been emitted had the first section excluded the reducing element; emitting a number of photons from the last section which equals or exceeds a number of photons which would have been emitted by the first section, had the first section excluded the reducing element; and utilizing the first section for a longer period of time compared to a period of time in which the first section would have been used, had the first section excluded the reducing element.

According to the present invention there is also provided a method of intensifying light images, comprising: providing a system to intensify light images, the system including a cascaded image intensifier comprising at least two sections in cascade, wherein each of a first and last section out of the at least two sections includes a photocathode unit adapted to convert photons to electrons and a screen unit adapted to convert electrons to photons, and wherein the first section includes a reducing element adapted to (i) reduce ion-caused degradation of a photocathode unit of the first section and (ii) reduce a number of photons exiting from the first section from a first value to a second value; using said system to intensify light images; recognizing degradation of at least one photocathode in the image intensifier, which causes a lower number of photons exiting from a last section of the image intensifier than before; and adjusting the system in order to increase a number of photons exiting from the last section of the image intensifier and thereby compensating for the degradation of the at least one photo cathode.

According to the present invention there is further provided an optical system for use in automatic inspection of articles progressing along a production line, the system comprising at least one light detection unit, the light detection unit comprising a comprising a light detector for detecting a light response of the article to incident electromagnetic radiation, and a cascaded image intensifier accommodated in an optical path of light propagating from the article to the light detector, the cascaded image intensifier configured to have an increased lifetime, thereby allowing increased throughput of the production line, the cascaded image intensifier comprising: at least two sections in cascade, wherein each of a first section and a last section out of the at least two sections includes a photocathode unit adapted to convert photons to electrons and a screen unit adapted to convert electrons to photons; wherein the first section includes a reducing element adapted to: (i) reduce ion-caused degradation of a photocathode unit of the first section, and (ii) reduce a number of photons exiting from the first section from a first value to a second value; and wherein the last section outputs a number of photons that equals or exceeds the first value.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF EXEMPLARY EMBODIMENTS

Described herein are embodiments of the present invention relating to an image intensifier including at least two sections in cascade.

As used herein, the phrase "for example," "such as" and variants thereof describing exemplary implementations of the present invention are exemplary in nature and not limiting.

Figure 1:
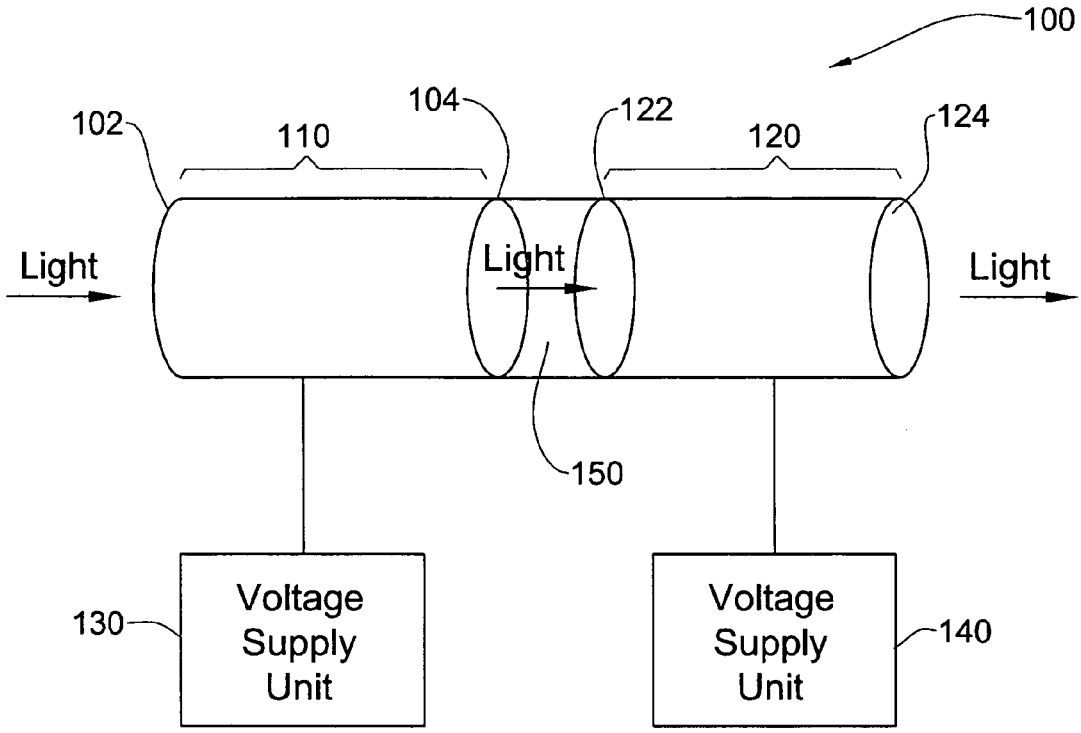
FIG. 1 schematically illustrates the configuration and operation of a cascaded image intensifier, according to an embodiment of the present invention.

Referring now to the drawings, FIG. 1 illustrates an image intensifier 100 comprising two sections 110 and 120 in cascade, optically coupled either directly or via suitable imaging transmission means 150 as will be described in more detail below. First section 110 includes a first photocathode unit 102 and a first screen unit 104. A first voltage supply unit 130 operates to apply appropriate voltages $V_0$ and $V_x$ ($V_x>V_0$) to, respectively the first photocathode unit 102 and the first screen unit 104 so as to provide a potential difference between them to thereby create an electric field attracting the flow of electrons emitted at photocathode unit 102 towards screen unit 104. Similarly, second section 120 includes a second photocathode unit 122 and a second screen unit 124. A second voltage supply unit 140 operates to apply appropriate voltages $V_t$ and $V_y$ ($V_y>V_t$) to, respectively the second photocathode unit 122 and the second screen unit 124 so as to provide a potential difference between them to thereby create an electric field attracting the flow of electrons emitted at photocathode unit 122 towards screen unit 124. In some embodiments, first supply unit 130 and second supply unit 140 may be the same unit.

First screen unit 104 is optically coupled to second photocathode unit 122 so as to transfer the photons converted by first screen unit 104 to second photocathode unit 122.

In order to illuminate to the reader the motivation for the invention, a simple example is provided of the operation of image intensifier 100. The example includes simplified numerical calculations in order to facilitate understanding and should therefore not be construed as typical or binding.

It is assumed in the example the following voltage supplies: voltage supply unit 130 provides $V_0=-10$ and $V_x=0$ KV; voltage supply unit 140 provides $V_t=0$ and $V_y=10$ KV. The Quantum Efficiency (QE) of a photocathode is expressed as a percentage of incoming photons to a photocathode unit which are converted by the photocathode unit into electrons. In this example, assume that the QE for each of photocathode unit 102 and 122 is 10%. The gain of the screen unit is expressed as the number of photons generated by the screen unit per electron and per KV (i.e. per kilo electron volt KeV). In this example, assume for each of screen unit 104 and 124 that the gain is 50 photons per KeV Assume in this example that the signal strength of photons incoming onto first photocathode unit 102 is $10^6$ photons. Therefore the electrons generated at first photocathode unit 102 with a QE of 10% is $10^5$ electrons. The generated electrons hit first screen unit 104, generating $5\times10^7$ photons (i.e. 50 gain×10 KV×$10^5$ electrons, neglecting energy loss on screen threshold). These photons are transferred to second photocathode unit 122, and the electrons generated at second photocathode unit 122 with a QE of 10% is $5\times10^6$ electrons. These electrons hit second screen unit 124, generating $2.5\times10^9$ photons (i.e. 50 gain×10 KV×$5\times10^6$ electrons, again neglecting energy loss on screen threshold).

As is known in the art, shot noise (one dominant noise origin in such systems) is proportional to the square root of a signal quantization. Therefore the signal to noise ratio SNR is smallest (worst) where the quantized signal is weakest. In the above example, the weakest signal is the electrons stream generated by first photocathode unit 102 ($10^5$ electrons). Therefore, any degradation in first photocathode unit 102 (i.e. a reduction in quantum efficiency) would have a negative impact on the overall signal to noise ratio in image intensifier 100. Degradation in other parameters, for example in the gain of either screen unit 104 and/or 124, and/or the QE of second photocathode unit 122, would not impact the overall signal to noise ratio of image intensifier 100, unless the degradation was severe enough to lower the signal (for example emitted by unit 104, 122 and/or 124) below the signal emitted by first photocathode unit 102.

It should be evident to the reader that the above example can be extrapolated to include more than two sections in an image intensifier, and in this case as well, degradation in the quantum efficiency of the photocathode unit in the first section would have an impact on the overall signal to noise ratio of the image intensifier whereas degradation in other parameters would only impact the overall signal to noise ratio if the degradation were severe enough to lower the signal at any point in the image intensifier below the signal emitted by the first photocathode unit.

The quantum efficiency of a photocathode unit may be negatively impacted by various factors. First, as a result of electrons hitting the screen unit, ions are formed. These ions may travel back and hit the photocathode unit, and may thus damage the photocathode unit. Second, gases, for example originating from a material in screen unit 104 (e.g. phosphor, lacquer, aluminum and/or blackening material, etc.) may damage the photocathode unit. Third, photons in the incoming light may damage the photocathode unit.

The quantum efficiency of a photocathode unit is related to the lifetime of the photocathode unit. Once the photocathode unit has degraded too much, the image intensifier may no longer meet the requirements of gain and/or signal to noise ratio. The decision on when the photocathode unit can be considered to have degraded too much depends on the embodiment, for example depending on the minimum total gain and/or on the minimum signal to noise ratio that can still be considered useful for that embodiment.

Embodiments of the present invention, contemplate methods and systems to protect the quantum efficiency of the first photocathode unit in an image intensifier comprising more than one section (for example first photocathode unit 102), by limiting the damage caused by ions (and optionally gases) feeding back onto the first photocathode unit. The methods and systems used to limit the damage from the ions (and optionally gases) also inherently cause the signal of photons emitted by the first screen unit to be lowered below the standard level of a traditional image intensifier comprising one section, but the photon signal emitted by the first screen unit is still significantly above the (photon) input signal into the first section, and therefore the operation of subsequent cascaded section(s) does not affect the total signal to noise ratio (assuming shot noise is the dominant noise, as in systems like this one). However, the subsequent cascaded section(s) compensate for the reduced photon signal from the first section so that the number of photons exiting the last section of the cascaded image intensifier is sufficiently high. In one embodiment, the number of photons exiting the last section of the cascaded image intensifier at least equals the number of photons which would have been emitted by the first screen unit had the number of photons not been limited by the methods and systems of the invention.

Figure 2:
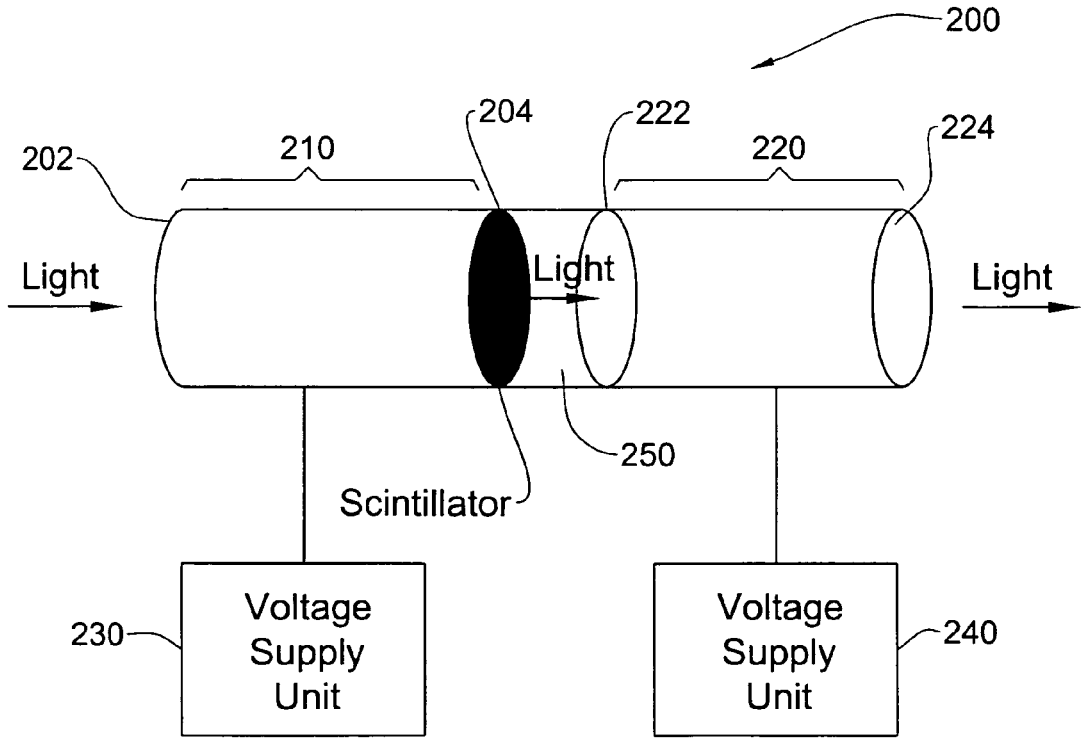
FIG. 2 schematically illustrates the configuration and operation of a cascaded image intensifier with a screen unit in the first section comprising a bulk scintillator, according to an embodiment of the present invention.

FIG. 2 illustrates a cascaded image intensifier 200, in accordance with various embodiments of the present invention. As in cascaded image intensifier 100, cascaded image intensifier 200 has a first section 210 comprising a first photocathode unit 202 and a first screen unit 204 with a first voltage supply unit 230 operating to apply appropriate voltages to the first section 210. Second section 220 comprises a second photocathode unit 222 and a second screen unit 224, with second voltage supply unit 240 (which may in some cases be the same unit as first supply unit 230) operating to apply appropriate voltages to the second section 220.

For ease of illustration, an image intensifier 200 is illustrated comprising two sections 210 and 220, but in other embodiments more than two sections may be present and the reader should understand that much of the description of the second section can also apply to any cascaded sections following the second section.

In the illustrated embodiment a bulk scintillator is used as first screen unit 204. The term "bulk" should be understood by the reader to refer to a non-powder form. Examples of bulk scintillators which may be used include inter-alia: YAG, YAP, ZnSe, CsI, NaI, LSO, LYSO. Depending on the embodiment, the bulk scintillator can be thick or thin, for example on another substrate such as fiber optics. Depending on the embodiment, the bulk scintillator can be a single crystal or can be in another bulk form.

For example, U.S. Pat. No. 5,633,493 to Suzuki et al, discloses an image intensifier with a single unitary solid (YAG crystal member) as a screen unit and is hereby incorporated by reference herein.

In one embodiment of cascaded image intensifier 200, the bulk scintillator used in screen unit 204 is however thinner than that disclosed in U.S. Pat. No. 5,633,493, for example about 3 to 5 microns, in order to better focus the photons on the photocathode unit 222 of the next section. This particular thickness should not be construed as binding and is presented solely for further illustration to the reader.

As is known in the art, bulk scintillators both emit less photons (smaller gain) and less ions when hit by an electron stream compared to the conventionally used phosphor screen unit (typically comprising a phosphor layer having a backing layer of aluminum). Phosphor comes in powder form and therefore the term "phosphor" refers to a screen material in powder form. Due to its powder form, the typical phosphor screen unit absorbs contaminants more easily than a screen unit comprising a bulk scintillator. These contaminants may become ions and get released from the screen when the screen unit is hit by the electrons. Therefore because first screen unit 204 comprises a bulk scintillator, the quantum efficiency of the first photocathode unit 202 is protected from degradation at the expense of the gain of first screen unit 204. For example, in one embodiment a bright phosphor such as P20 may have a gain of about 35 to 65 photons per KeV whereas a bulk scintillator such as YAG may have a gain of about 8 photons per KeV. This numerical example of gains is not binding and is presented solely for further illustration to the reader.

In one embodiment, the lowered gain of first (bulk scintillator) screen unit 204 compared to what the gain would have been had the first screen unit been a phosphor screen unit is at least compensated for by the second section 220 of cascaded image intensifier 200 (or if there are more that two sections then the compensation can occur in any one or combination of sections following the first section). In other words, in this embodiment the light emitted by the last section of cascaded image intensifier 200 should at least be as strong as the light which would have been emitted by the first screen unit had the first screen unit comprised phosphor rather than a bulk scintillator.

Depending on the embodiment, the second screen unit 224 (and/or subsequent) may comprise a conventional phosphor screen unit or a bulk scintillator.

Each section 210, 220, etc. of cascaded image intensifier 200 may comprise any generation of image intensifier and may use any focusing method, as appropriate.

As is known in the art, there are several known generations of image intensifiers: The so-called "first generation image intensifiers" are intensifier diodes that utilize only a single potential difference to accelerate electrons from the cathode to the anode (screen). The "second generation image intensifiers" utilize electron multipliers, i.e., not only the energy but also the number of electrons between input and output is significantly increased. Multiplication is achieved by use of a device called microchannel plate (MCP), i.e. a thin plate of conductive glass containing many small holes. In these holes, secondary electron emission occurs which leads to multiplication factors of up to four orders of magnitude. The "third generation image intensifiers" employ MCP intensifiers with Gallium-Arsenide GaAs photocathodes (instead of multialkali photocathodes such as Cs, Sb, K, Na, etc. normally used in first and second generation intensifiers, or instead of bialkali or solar blind (CsTs) sometimes used in first or second generation intensifiers.). The usage of GaAs increases a luminous sensitivity of approximately 1,200 μA/lm instead of 300 μA/lm found in the multialkali photocathodes. These GaAs photocathodes are also much more sensitive in the NIR region of the light spectrum. Modified third generation image intensifiers which are filmless (i.e. without an ion barrier film IBF) are sometimes termed "fourth generation image intensifiers" or may be grouped under the term "third generation image intensifiers".

In these intensifiers, focusing is achieved by any of three approaches. The first approach includes placing the screen in close proximity to the photocathode (proximity focus image intensifier). In the second electrostatic approach, electrodes focus electrons originating from the photocathode onto the screen (electrostatic image intensifier or inverter image intensifier). In the third magnetic focus approach, a magnetic field parallel to the optical axis causes electrons to complete exactly one (or complete multiplication of one) full turn (magnetically focused image intensifier).

In some cases, one or more sections of image intensifier 200 may have more than one focusing, for example if an MCP is used, and the more than one focusing may all use the same focusing approach or may use a plurality of different focusing approaches.

The voltage supply units 230, 240, etc may each supply one or more potentials of appropriate levels to the first and to subsequent section(s) respectively of cascaded image intensifier 200, depending on the embodiment. For example if an MCP is included in a section, there may in some cases be a potential difference between the photocathode unit and the MCP, between the MCP and the screen unit, and at the MCP, whereas if no MCP is included in a section, there may in some cases be a potential difference only between the photocathode unit and the screen unit. For example, in one embodiment, a section comprising a first generation image intensifier may have a conventional potential difference of about 8 to 15 KV between the photocathode and the screen unit. For example, in another embodiment, a section comprising a first generation image intensifier may have a higher potential difference of about 20 to 30 KV between the photocathode and the screen unit. For example, in one embodiment, a section comprising a second or third generation image intensifier may conventionally have about 200V between the photocathode unit and MCP (or about 800V if an IBF is present), about 5 to 7 KV between the MCP and the screen unit, and about 200 to 1500V at the MCP. These operational parameters are presented solely for further illustration to the reader and should not be construed as binding.

The screen unit of all but the last section of cascaded image intensifier 200 is optically coupled to the next photocathode unit so as to transfer the photons converted by the screen unit to the next photocathode unit. For example the screen unit of any section (except the last section) may be attached to the photocathode unit of the next section, using any suitable imaging transmission means 250, for example a fiber optic plate, a thin film such as mica, etc. In some cases when the screen unit comprises a bulk scintillator, the photocathode unit of the next section may be connected directly to the bulk scintillator without the usage of such imaging transmission means, however in other cases the connection is via such imaging transmission means. For example, U.S. Pat. No. 5,315,103 to Raverdy et al and U.S. Pat. No. 5,319,189 to Beauvais et al describe how a photocathode can be connected directly to a scintillator, and are hereby incorporated by reference herein.

Depending on the embodiment, the different sections 210, 220, etc. of cascaded image intensifier 200 may be detachably attached together or may be permanently attached together.

In accordance with some embodiments of the invention, as long as the light emitted by the last section of cascaded image intensifier 200 is at least as strong as the light which would have been emitted by first screen unit 204, had first screen unit 204 been a phosphor screen unit instead of comprising a bulk scintillator, any combination of parameters in subsequent cascaded section(s) of image intensifier 200 which provide for such light strength to be emitted by image intensifier 200 are within the scope of the invention. Examples of parameters which may affect the light strength include inter-alia: voltage difference supplied by subsequent supply unit(s) 240, gain of subsequent screen unit(s) 224, QE of subsequent photocathode unit(s) 222, secondary electron multiplication provided by electron multiplier(s) such as MCP(s) in subsequent section(s), etc.

Figure 3:
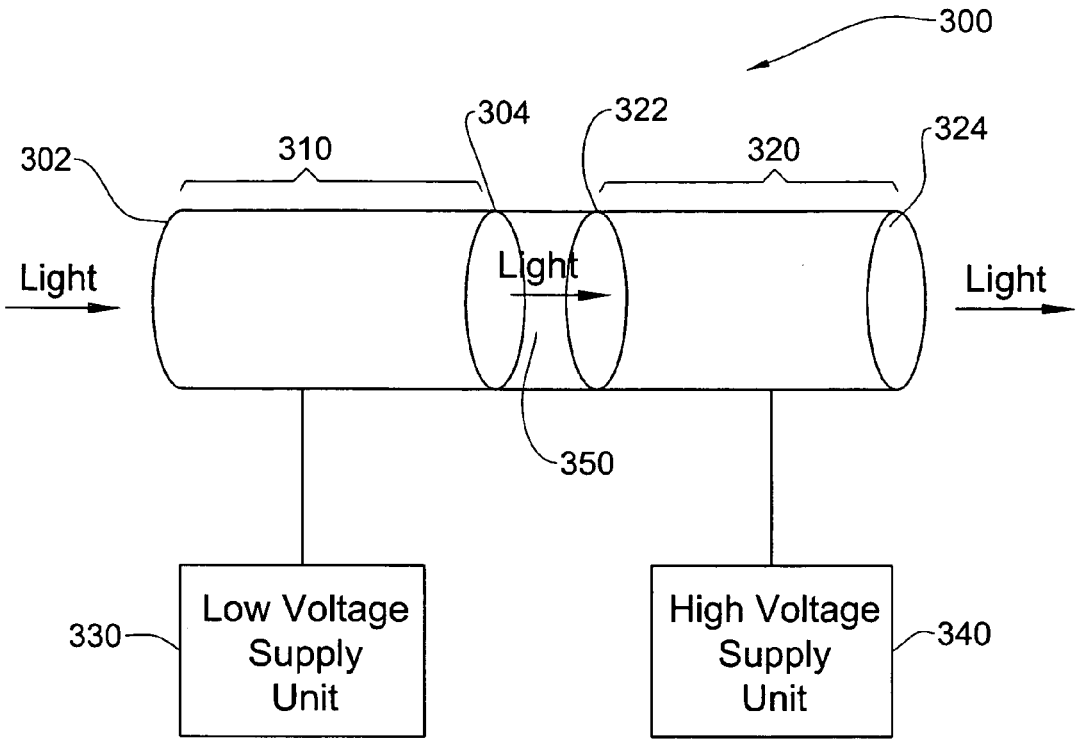
FIG. 3 schematically illustrates the configuration and operation of a cascaded image intensifier with a lower potential difference applied to the first section compared to subsequent sections, according to an embodiment of the present invention.

FIG. 3 illustrates cascaded image intensifier 300, in accordance with some embodiments of the current invention. As in cascaded image intensifier 100, cascaded image intensifier 300 has a first section 310 comprising a first photocathode unit 302 and a first screen unit 304 with a first voltage supply unit 330 operating to apply appropriate voltages to the first section 310. Second section 320 comprises a second photocathode unit 322 and a second screen unit 324, with second voltage supply unit 340 (which may in some cases be the same unit as first supply unit 330) operating to apply appropriate voltages to the second section 320. For ease of illustration, an image intensifier is illustrated comprising two sections 310 and 320, but in other embodiments more than two sections may be present and the reader should understand that much of the description of the second section can also apply to any cascaded sections following the second section.

In the illustrated embodiment, each section 310, 320, etc of cascaded image intensifier 300 is a first generation image intensifier. There is a lower accelerating voltage in first section 310, i.e. the potential difference between first screen first photocathode unit 302 and first screen unit 302 in first section 310 is lower than the potential difference between second photocathode unit 322 and second screen unit 322 in second section 320. For example the potential difference between first photocathode unit 302 and first screen unit 304 may be about 6 to 10 KV and the potential difference between second photocathode unit 322 and second screen unit 324 may be about 20 to 30 KV. These operational parameters are presented solely for further illustration to the reader and should not be construed as binding. Any optional sections after the second section 320 would also have a higher potential difference compared to first section 310 in this embodiment.

Because of the low accelerating voltage in first section 310, ions which are fed back to first photocathode unit 302 have less energy and therefore cause less damage to the active region of the photocathode unit 302 (thereby preserving the QE and lifetime of the photocathode unit 302). In some cases due to the low accelerating voltage, fewer ions may also be produced at first screen unit 304 (due to lower energy of the hitting electrons). However due to the low accelerating voltage, the photons emitted by first screen unit 304 are less than if the accelerating voltage was higher (since the number of photons equal the number of incoming electrons×(the potential difference−the screen threshold)×the gain of the screen).

In one embodiment, the lower signal emitted by first screen unit 304 (due to the lower accelerating voltage in first section 310 compared to the accelerating voltage in subsequent section(s)) is at least compensated for by the second section 320 of cascaded image intensifier 300 (or if there are more than two sections then the compensation can occur in any one or combination of sections following the first section). In other words, in this embodiment the light emitted by the last section of cascaded image intensifier 300 should at least be as strong as the light which would have been emitted by the first screen unit 304 had the accelerating voltage in section 310 been high like the accelerating voltage in section 320.

Each section 310, 320, etc of cascaded image intensifier 300 may use any one or more focusing approaches, as appropriate and as described above with reference to FIG. 2.

Depending on the embodiment, each screen unit 304 and 324 (and optionally subsequent) may comprise a conventional phosphor screen unit (typically a phosphor layer structure on a glass (or fiber optic plate) substrate) or a bulk scintillator. As described above with reference to FIG. 2, the screen unit of all but the last section of cascaded image intensifier 300 is optically coupled to the next photocathode unit using any suitable image transmission means 350 or alternatively in some cases when the screen unit is a bulk scintillator the photocathode unit of the next section may be directly connected to the bulk scintillator as described above. Depending on the embodiment, the different sections 310, 320, etc. of image intensifier 300 may be detachably attached together or may be permanently attached together.

In accordance with some embodiments, as long as the light emitted by the last section of cascaded image intensifier 300 is at least as strong as the light which would have been emitted by first screen unit 304, had the accelerating voltage in first section 310 been as high as the accelerating voltage in subsequent sections, any combination of parameters in subsequent cascaded section(s) of image intensifier 300 which provide for such light strength to be emitted by image intensifier 300 are within the scope of the invention. Examples of parameters which may affect the light strength include inter-alia: voltage difference supplied by subsequent supply unit(s) 340, gain of subsequent screen unit(s) 324, QE of subsequent photocathode unit(s) 322, secondary electron multiplication provided by electron multiplier(s) such as MCP(s) in subsequent section(s), etc.

Figure 4:
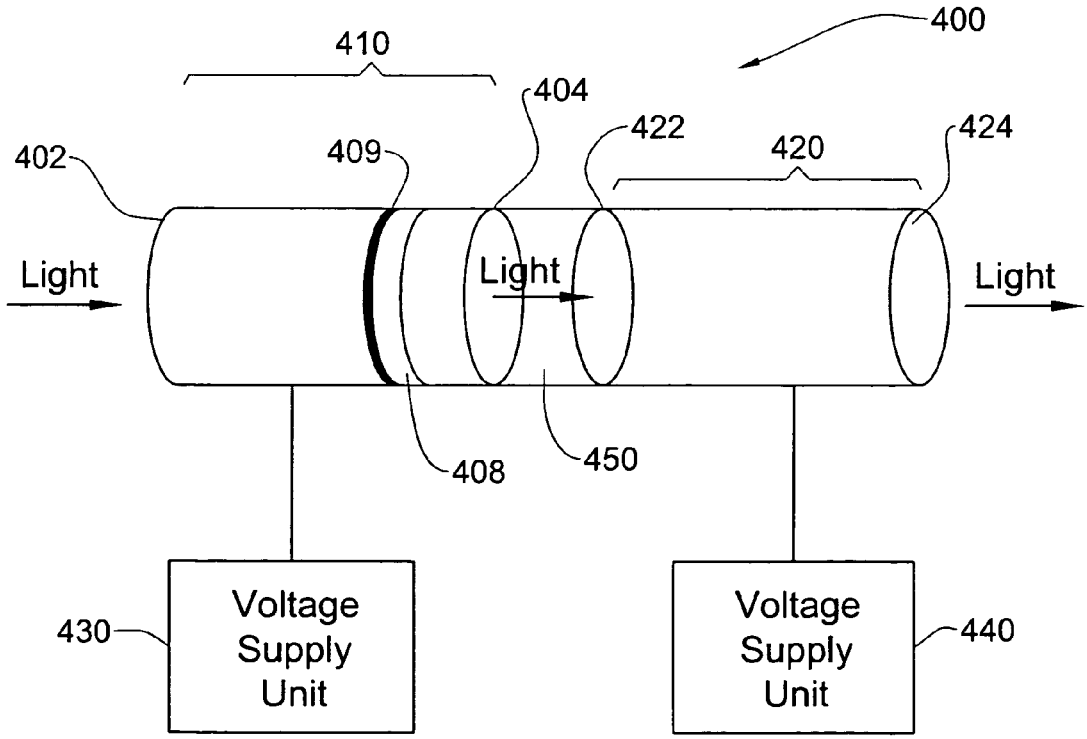
FIG. 4 schematically illustrates the configuration and operation of a cascaded image intensifier with a first section comprising an ion barrier film and a bialkali, solar blind or multialkali photocathode, according to an embodiment of the present invention.

FIG. 4 illustrates a cascaded image intensifier 400 according to various embodiments of the present invention.

As in cascaded image intensifier 100, cascaded image intensifier 400 has a first section 410 comprising a first photocathode unit 402 and a first screen unit 404 with a first voltage supply unit 430 operating to apply appropriate voltages to the first section 410. Second section 420 comprises a second photocathode unit 422 and a second screen unit 424, with second voltage supply unit 440 (which may in some cases be the same unit as first supply unit 430) operating to apply appropriate voltages to the second section 420. For ease of illustration, an image intensifier is illustrated comprising two sections 410 and 420, but in other embodiments more than two sections may be present and the reader should understand that much of the description of the second section can also apply to any cascaded sections following the second section.

In the illustrated embodiment, first section 410 comprises a bialkali, solar blind or multi-alkali photocathode unit 402, and an MCP 408 as per the conventional second generation image intensifier. However, in this embodiment an ion barrier film IBF 409 is added between the MCP 408 and the first photocathode unit 402, for example attached to the respective surface of MCP 408. IBF 409 may be for example a thin film made of aluminum, carbon, silicon, silicon oxide, etc. IBF 409 may have a thickness of about tens of nanometers (e.g. ~30 nm). The thickness of IBF 409 is presented solely for further illustration to the reader and should not be construed as binding. The use of IBF 409 is advantageous because the IBF bars an ion flow exiting the MCP 408 toward photocathode 402. This ion flow might be a result of ionization of free gas near the MCP surface when hit by high energy electrons. The IBF 409 also bars the gasses existing in the vacuum tube from reaching photocathode 402, thus protecting the image intensifier from the $2^{nd}$ order damage mechanism.

In one embodiment the operational parameters supplied by voltage supply unit 430 are as follows: about 800 V potential difference between the photocathode 402 and the MCP 408, about 5 to 7 KV potential difference between the MCP 408 and the screen 404, and about 200 to 1500 V at MCP 408. These operational parameters should not be construed as binding and are presented solely for further illustration to the reader.

In an alternative embodiment, MCP 408 is omitted, and first section 410 includes a bialkali, solar blind or multi-alkali photocathode unit 402 as per the conventional first generation image intensifier. However, in this embodiment an ion barrier film IBF 409 is added between first screen unit 404 and first photocathode unit 402, thereby barring an ion flow back to photocathode unit 402. As above, IBF 409 is a thin film made of aluminum, carbon, silicon, silicon oxide etc. with thickness of about tens of nanometers (e.g. ~30 nm). The IBF 409 might be self supported or sit on a low fill factor mesh or another thin self supporting material. IBF 409 is preferably located either in the middle area of the tube, or closer to photocathode unit 402 (at a distance of about 200-500 μm). The thickness of IBF 409 and the positioning of IBF 409 is presented solely for further illustration to the reader and should not be construed as binding.

In one embodiment, the operational parameters supplied by voltage supply unit 430 are as follows, assuming the IBF 409 is in the middle of the tube: 800 V to 5 KV potential difference between photocathode 402 and the IBF 409, and a 6 to 30 KV potential difference between the IBF 409 and the screen 404.

In one embodiment, if IBF 409 is not in the middle of the tube, the potential difference between photocathode 402 and the IBF 409 is about 800 V, and there is about a 6 to 30 KV potential difference between the IBF 409 and the screen 404.

These operational parameters should not be construed as binding and are presented solely for further illustration to the reader.

First section 410 may use any one or more focusing means discussed above with reference to FIG. 2.

More information on section 410 is provided in U.S. Ser. No. 11/460,575 titled "Image Intensifier Device and Method" which is co-assigned and was filed on Jul. 27, 2006 and which is hereby incorporated by reference herein.

Although IBF 409 protects the quantum efficiency and the lifetime of first photocathode unit 402 by preventing ion feedback, IBF 409 also reduces the photon signal emitted by screen unit 404 of first section 410. The reduction in the signal can be attributed to the absorption by IBF 409 of some of the electrons, thereby causing less electrons to impinge on first screen unit 404. For example, in one embodiment the amount of photons generated by first screen unit 404 is about 50% to 70% of the number which would have been generated had section 410 excluded IBF 409. In this embodiment, the percentage may vary depending on the material and thickness of IBF 409. These percentages are provided solely for illustration to the reader and should not be construed as binding.

In one embodiment, the lowered signal emitted by first section 410 due to IBF 409 compared to a conventional first generation (conventional having no MCP 408 and no IBF 409) or second generation image intensifier (conventional having MCP 408 but no IBF 409) is at least compensated for by the second section 420 of image intensifier 400 (or if there are more that two sections then the compensation can occur in any one or combination of sections following the first section). In other words, in this embodiment the light emitted by the last section of cascaded image intensifier 400 should at least be as strong as the light which would have been emitted by the first screen unit 404 had first section 410 been a conventional first/second generation image intensifier.

Each section of cascaded image intensifier 400 after the first section 410, for example 420, etc of may comprise any generation of image intensifier and may use any one or more focusing approaches, as appropriate and as described above with reference to FIG. 2.

In one embodiment, the voltages supplied to section 420 and optionally to subsequent sections of cascaded image intensifier 400 are as follows. For example, in one embodiment, a section comprising a first generation image intensifier may have a conventional potential difference of about 8 to 15 KV between the photocathode and the screen unit. For example, in another embodiment a section comprising a first generation image intensifier may have a higher potential difference of about 20 to 30 KV between the photocathode and the screen unit. For example, in one embodiment, a section comprising a second or third generation image intensifier may conventionally have about 200V between the photocathode unit and MCP (or about 800V if an IBF is present), about 5 to 7 KV between the MCP and the screen unit, and about 200 to 1500V at the MCP. These operational parameters are presented solely for further illustration to the reader and should not be construed as binding.

Depending on the embodiment, each screen unit 404 and 424 (and optionally subsequent) may comprise a conventional phosphor screen unit (typically a phosphor layer structure on a glass/fiber optic plate substrate) or a bulk scintillator. As described above with reference to FIG. 2, the screen unit of all but the last section of cascaded image intensifier 400 is optically coupled to the next photocathode unit using any suitable image transmission means 450 or alternatively in some cases when the screen unit is a bulk scintillator the photocathode unit of the next section may be directly connected to the bulk scintillator as described above. Depending on the embodiment, the different sections 410, 420, etc. of image intensifier 400 may be detachably attached together or may be permanently attached together.

In accordance with some embodiments, as long as the light emitted by the last section image intensifier 400 from the last section is at least as strong as the light which would have been emitted by first screen unit 404, had first section 410 been a conventional first or second generation image intensifier, any combination of parameters in subsequent cascaded section(s) of image intensifier 400 which provide for such light strength to be emitted by image intensifier 400 are within the scope of the invention. Examples of parameters which may affect the light strength include inter-alia: voltage difference supplied by subsequent supply unit(s) 440, gain of subsequent screen unit(s) 424, QE of subsequent photocathode unit(s) 422, secondary electron multiplication provided by electron multiplier(s) such as MCP(s) in subsequent section(s), etc.

In some embodiments of the invention, the quantum efficiency of one or more photocathode unit(s) in one or more sections of image intensifier (e.g. 200, 300, 400) may be reduced, resulting in a lower signal(s) of electrons exiting from the photocathode unit(s).

For example, in some of these embodiments, one or more photocathode unit(s) used in one or more subsequent section (s) (i.e. after the first) of the cascaded image intensifier (e.g. 200, 300, 400) may be more robust but may have lower quantum efficiency, For example the quantum efficiency of the subsequent photocathode unit(s) may be lower than the quantum efficiency of the first photocathode unit (in the first section). For example, in some cases a bi-alkali photocathode is more robust but has lower quantum efficiency, and may be used in these subsequent section(s). It is not critical that the quantum efficiency of the photocathode(s) in the subsequent section(s) be as high as the quantum efficiency of the photocathode in the first section because there are significantly more photons incoming onto the photocathode unit(s) in the subsequent section(s) than onto the photocathode in the first section. For example, in one embodiment a bi-alkali photocathode may in some cases have about a 3% quantum efficiency compared to a multi-alkali photocathode with quantum efficiency of about 10% and a GaAs photocathode with quantum efficiency of about 20% at green light. These percentages are provided solely for further illustration to the reader and should not be construed as binding.

As another example, in some of these embodiments, the quantum efficiency of photocathode unit(s) of the cascaded image intensifier (e.g. 200,300, 400) may degrade with use (for example due to ion feedback, impinging photons and/or gases). In embodiments where it is desirable to maintain the same level of photon emission from the cascaded image intensifier throughout the lifetime of the cascaded image intensifier, the initial gain from the cascaded image intensifier may be attenuated at the beginning (from the maximum gain achievable by the image intensifier). For example, in one of these embodiments, in order to compensate for eventual degradation of the first photocathode unit in the first section, there may initially be attenuation in light collection optics in front of the cascaded image intensifier, with the attenuation removed or reduced as the first photocathode unit (i.e. in the first section of the cascaded image intensifier) degrades. The collection optics can include inter-alia, one or more polarizers, etc. Continuing with the example, if the collection optic includes a plurality of polarizers, the angle between two or more of the polarizers may be changed in order to change the transmission through the polarizers. Still continuing with the example, another option would be to initially insert optical filters which are later removed. As another example, in one of these embodiments, in order to compensate for degradation in photocathode unit(s) in section(s) after the first section of the cascaded image intensifier, the gain in one or more sections of the cascaded image intensifier may be initially set to be less than the maximum and later increased, for example by increasing the amount of electrons in a section (for example using MCP(s)) or by increasing the potential difference(s) in a section.

In one embodiment, the cascaded image intensifier 200, 300 or 400 described above have an increased lifetime. An increased lifetime is important in various applications, e.g. automatic inspection of articles (e.g. wafers) progressing along a production line, where the lifetime of the image intensifier(s) used in the inspection system is one of the factors affecting the throughput of the production line (the high throughput requires long lifetime image intensifier(s) since it requires continuous high power image intensifiers).

Figure 5:
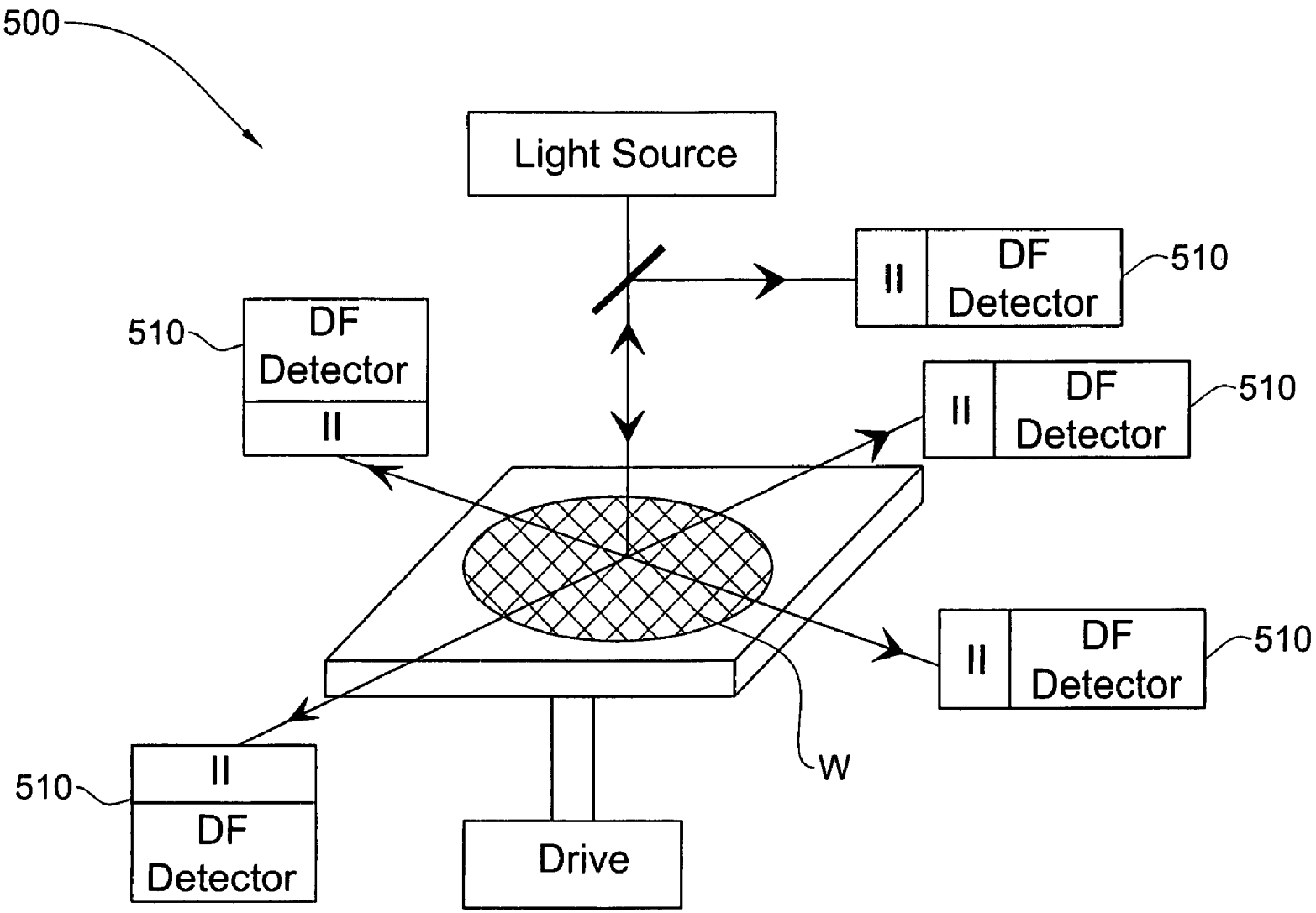
FIG. 5 exemplifies an automatic inspection system for inspecting wafers utilizing the cascaded image intensifier device of the present invention.

FIG. 5 schematically shows an example of an automatic inspection system, generally at 500 for inspecting semiconductor wafers W. System 500 includes a light source unit, a light detection unit, and appropriate light directing/collecting means. In the present example, system 500 is configured to operate in dark-field inspection mode using multiple dark-field detectors, and also in bright-field inspection mode. The principles of dark- and bright-field inspection are known per se and therefore need not be specifically described, except to note the following. In system 500, all the detection units collect radiation scattered from a common area on the wafer surface, and each one of the dark-field detection units is configured to collect the radiation along a different angular axis (i.e., a different elevation and/or azimuth). Each detection unit includes a cascaded image intensifier 510 of the present invention (i.e. each cascaded image intensifier 510 may comprise any of the various embodiments of cascaded image intensifier 200, 300, 400 described above) accommodated in front of a respective light detector.

While the invention has been shown and described with respect to particular embodiments, it is not thus limited. Numerous modifications, changes and improvements within the scope of the invention will now occur to the reader.

The invention claimed is:

1. A cascaded image intensifier, comprising:

at least two sections in cascade, each of a first section and a last section out of said at least two sections including a photocathode unit adapted to convert photons to electrons and a screen unit adapted to convert electrons to photons;

wherein said first section includes a reducing element adapted to: (i) reduce ion-caused degradation of a photocathode unit of said first section, and (ii) reduce a number of photons exiting from said first section from a first value to a second value; and wherein said last section outputs a number of photons that equals or exceeds said first value.

2. The cascaded image intensifier of claim 1, wherein said reducing element includes a bulk scintillator included in a screen unit of said first section, and said first value is associated with a phosphor screen unit.

3. The cascaded image intensifier of claim 2, wherein said bulk scintillator has a thickness that substantially ranges between 3 to 5 microns.

4. The cascaded image intensifier of claim 1, wherein said reducing element is adapted to provide a potential difference between a photocathode unit and a screen unit in said first section that substantially ranges between 6 to 10 KV, and said first value is associated with a potential difference that substantially ranges between 20 to 30 KV; and wherein a potential difference that substantially ranges between 20 to 30 KV is provided between a photocathode unit and a screen unit in a section subsequent to said first section.

5. The cascaded image intensifier of claim 4, wherein said first section and said subsequent section include photocathode units which are made of material differing from Gallium Arsenide, and wherein said first section and said subsequent section do not comprise any microchannel plates.

6. The cascaded image intensifier of claim 1, wherein said first section includes a photocathode unit made of material differing from Gallium-Arsenide, and said reducing element includes an ion barrier film; and wherein said first value is associated with an absence of said ion barrier film.

7. The cascaded image intensifier of claim 6, wherein said first section further includes a microchannel plate between said ion barrier film and said screen unit in said first section.

8. The cascaded image intensifier of claim 1, wherein a photocathode in at least one section after said first section has a lower quantum efficiency than a photocathode in said first section.

9. The cascaded image intensifier of claim 1, wherein said number of photons outputted by said last section of said image intensifier is substantially equal to said first value.

10. The cascaded image intensifier of claim 1, wherein at least one section of said image intensifier subsequent to said first section excludes said reducing element.

11. The cascaded image intensifier of claim 1, wherein said reducing element includes both an ion barrier film and a bulk scintillator included in a screen unit of said first section.

12. The cascaded image intensifier of claim 1, wherein said reducing element includes both a bulk scintillator included in a screen unit of said first section and an element adapted to provide a potential difference between a screen unit and a photocathode unit in said first section that substantially ranges between 6 to 10 KV.

13. The cascaded image intensifier of claim 1, wherein an optical coupling between a screen unit of a section and a photocathode unit of a next section includes a fiber optic plate.

14. The cascaded image intensifier of claim 1, wherein an optical coupling between a screen unit of a section and a photocathode unit of a next section includes a thin film.

15. The cascaded image intensifier of claim 14, wherein said thin film is mica.

16. The cascaded image intensifier of claim 1 wherein a photocathode unit of a section is connected directly to a bulk scintillator screen unit of a previous section.

17. A cascaded image intensifier, comprising:

at least two sections in cascade, each of a first section and a last section out of said at least two sections including a photocathode unit adapted to convert photons to electrons and a screen unit adapted to convert electrons to photons;

wherein a screen unit in said first section includes a bulk scintillator; and wherein said last section outputs a number of photons that equals or exceeds a number of photons which would have been outputted by said first section, had said first section instead included a phosphor screen unit.

18. A cascaded image intensifier, comprising:

at least two sections in cascade, each of a first section and a last section out of said at least two section including a photocathode unit adapted to convert photons to electrons and a screen unit adapted to convert electrons to photons; and at least one voltage supply unit adapted to provide a potential difference between a photocathode unit and a screen unit in said first section that substantially ranges between 6 to 10 KV, and adapted to provide a potential difference between a photocathode unit and a screen unit in a section subsequent to said first section that substantially ranges between 20 to 30 KV;

wherein said last section outputs a number of photons that equals or exceeds a number of photons which would have been outputted by said first section, had said at least one voltage supply unit been adapted to instead provide a potential difference between said photocathode unit and said screen unit in said first section that substantially ranges between 20 to 30 KV.

19. A cascaded image intensifier, comprising:

at least two sections in cascade, each of a first section and a last section out of said at least two sections including a photocathode unit adapted to convert photons to electrons and a screen unit adapted to convert electrons to photons, said photocathode unit in said first section made of material differing from Gallium-Arsenide; and an ion barrier film in said first section;

wherein said last section outputs a number of photons that equals or exceeds a number of photons which would have exited from said first section, had said first section excluded said ion barrier film.

20. A method of increasing a lifetime of a cascaded image intensifier, comprising:

providing an image intensifier comprising at least two sections in cascade, wherein each of a first and last section out of said at least two sections includes a photocathode unit adapted to convert photons to electrons and a screen unit adapted to convert electrons to photons, and wherein said first section comprises a reducing element adapted to reduce ion-caused degradation of a photocathode unit;

receiving light directed toward said image intensifier;

limiting a number of photons emitted by said first section compared to a number of photons which would have been emitted had said first section excluded said reducing element;

emitting a number of photons from said last section which equals or exceeds a number of photons which would have been emitted by said first section, had said first section excluded said reducing element; and utilizing said first section for a longer period of time compared to a period of time in which said first section would have been used, had said first section excluded said reducing element.

21. A method of intensifying light images, comprising:

providing a system to intensify light images, said system including a cascaded image intensifier comprising at least two sections in cascade, wherein each of a first and last section out of said at least two sections includes a photocathode unit adapted to convert photons to electrons and a screen unit adapted to convert electrons to photons, and wherein said first section includes a reducing element adapted to (i) reduce ion-caused degradation of a photocathode unit of said first section and (ii) reduce a number of photons exiting from said first section from a first value to a second value;

using said system to intensify light images;

recognizing degradation of at least one photocathode in said image intensifier, which causes a lower number of photons exiting from a last section of said image intensifier than before; and adjusting said system in order to increase a number of photons exiting from said last section of said image intensifier and thereby compensating for said degradation of said at least one photocathode.

22. The method of claim 21, wherein said system further comprises collection optics, said method further comprising:

prior to using said system, attenuating said collection optics;

wherein said recognizing includes: recognizing degradation in a photocathode in a first section of said cascaded image intensifier;

and wherein said adjusting includes reducing said attenuating.

23. The method of claim 21, wherein said recognizing includes: recognizing degradation in a photocathode in a section other than said first section; and wherein said adjusting includes: adjusting the electron multiplication of at least one microchannel plate in said cascaded image intensifier.

24. The method of claim 21, wherein said recognizing includes: recognizing degradation in a photocathode in a section other than said first section; and wherein said adjusting includes increasing a potential difference in at least one section of said cascaded image intensifier.

25. An optical system for use in automatic inspection of articles progressing along a production line, the system comprising at least one light detection unit, the light detection unit comprising a light detector for detecting a light response of the article to incident electromagnetic radiation, and a cascaded image intensifier accommodated in an optical path of light propagating from the article to the light detector, the cascaded image intensifier configured to have an increased lifetime, thereby allowing increased throughput of the production line, said cascaded image intensifier comprising: at least two sections in cascade, wherein each of a first section and a last section out of said at least two sections includes a photocathode unit adapted to convert photons to electrons and a screen unit adapted to convert electrons to photons; wherein said first section includes a reducing element adapted to: (i) reduce ion-caused degradation of a photocathode unit of said first section, and (ii) reduce a number of photons exiting from said first section from a first value to a second value; and wherein said last section outputs a number of photons that equals or exceeds said first value.

* * * * *